US006898826B2

(12) United States Patent
Draper et al.

(10) Patent No.: US 6,898,826 B2
(45) Date of Patent: May 31, 2005

(54) CO-MOLDED LADDER STRAP

(75) Inventors: Alexander D. Draper, Seattle, WA (US); Nigel Bruce Edward Steere, Seattle, WA (US); Kenneth Wayne Heinle, Snohomish, WA (US)

(73) Assignee: K-2 Corporation, Vashon, WA (US)

( * ) Notice: Subject to any disclaimer, the term of this patent is extended or adjusted under 35 U.S.C. 154(b) by 97 days.

(21) Appl. No.: 10/337,172

(22) Filed: Jan. 6, 2003

(65) Prior Publication Data

US 2004/0128803 A1 Jul. 8, 2004

(51) Int. Cl.[7] ..... A44B 11/00; A43C 11/14; A63C 9/04; B65D 63/00

(52) U.S. Cl. ..... 24/68 SK; 24/68 R; 24/170; 24/191; 280/14.22; 280/634

(58) Field of Search ..... 24/68 SK, 68 R, 24/170, 191, 709; 280/634, 618, 14.2, 14.22

(56) References Cited

U.S. PATENT DOCUMENTS

| | | | | |
|---|---|---|---|---|
| 4,683,620 A | * | 8/1987 | Valsecchi et al. | 24/71 SK |
| 4,941,236 A | * | 7/1990 | Sherman et al. | 24/265 WS |
| 5,852,852 A | | 12/1998 | Rigal | |
| 5,970,585 A | * | 10/1999 | Scholey | 24/482 |
| 6,036,560 A | * | 3/2000 | Pekar | 441/65 |
| 6,076,848 A | | 6/2000 | Rigal et al. | |
| 6,106,235 A | | 8/2000 | Tettenborn et al. | |
| 6,206,403 B1 | | 3/2001 | Black et al. | |
| 6,209,174 B1 | | 4/2001 | Selby | |
| 6,250,651 B1 | | 6/2001 | Reuss et al. | |
| 6,256,847 B1 | * | 7/2001 | Manley et al. | 24/593.11 |
| 6,267,390 B1 | | 7/2001 | Maravetz et al. | |
| 6,293,566 B1 | | 9/2001 | Carpenter et al. | |
| 6,520,511 B2 | * | 2/2003 | Gonthier | 280/14.22 |
| 6,554,297 B2 | * | 4/2003 | Phillips et al. | 280/14.22 |
| 6,669,211 B2 | * | 12/2003 | Gonthier | 280/14.22 |
| 2001/0001048 A1 | | 5/2001 | Gonthier | |
| 2002/0101062 A1 | | 8/2002 | Andrevon | |

FOREIGN PATENT DOCUMENTS

| | | |
|---|---|---|
| DE | 70 23 385 U | 9/1970 |
| EP | 1 238 597 A | 9/2002 |

* cited by examiner

*Primary Examiner*—Victor Sakran
(74) *Attorney, Agent, or Firm*—Christensen O'Connor Johnson Kindness PLLC

(57) ABSTRACT

A ladder strap (150) is made by joining—for example, by co-molding—a first, relatively supple material, defining a lower strap portion (155) with a second, relatively hard material defining an upper strap portion (165). The teeth (167) of the ladder strap are comprises substantially of the harder, second material. In a preferred embodiment, the first and second materials are thermoplastic urethanes, and the co-molding is done using an injection molding process. The co-molding process may be accomplished with co-injection, wherein the two materials are injected at about the same time, or the first material may be injected into a first mold cavity and allowed to partially set, after which the cavity is modified to accommodate the second material.

9 Claims, 4 Drawing Sheets

CO-MOLDED LADDER STRAP

FIELD OF THE INVENTION

The present invention relates generally to straps for sports equipment and, in particular, to ladder straps that are particularly suited for sports equipment binding.

BACKGROUND OF THE INVENTION

Adjustable straps are frequently used in sporting equipment, particularly footwear, to provide a releasable-yet-rugged attachment for securing a user's foot in the footwear—such as ski boots, snowboard boots, in-line skates, and the like—and/or for securing the footwear to a sports device, such as a snowboard or ski. A ubiquitous strap for such applications is the serrated strap, also commonly referred to as a "ladder strap." A ladder strap is generally a flexible, elongate strap having a plurality of closely-spaced, transverse ridges or teeth that are adapted to engage a buckle assembly, typically a ratchet-type buckle, whereby the buckle releasably holds the strap in a tensioned condition.

The teeth of a ladder strap are generally integrally formed in the strap and typically have a triangularly-shaped profile, although other profile shapes, such as square or trapezoidal, are sometimes used. A buckle assembly commonly includes a movable holding element that is biased towards the teeth of a ladder strap inserted in the buckle. The buckle is adapted to permit the ladder strap to be inserted and pushed through the buckle in one direction for tightening, while inhibiting or preventing the strap from backsliding in the opposite direction. A lever or other device is provided on the buckle that allows the user to move the holding element away from the ladder strap, whereby the strap can be loosened. Many buckle assemblies further include a tightening apparatus—for example, a levered ratchet-type device—that drivably engages the ladder strap teeth. A ratchet-type buckle permits the user to apply relatively high tension in the strap for a tight fit. The teeth of the strap must be rugged enough to repeatedly endure the significant stresses that may be applied by the ratchet assembly to tighten the strap.

A typical application for a ladder strap is shown, for example, in FIG. 1, wherein a snowboard binding assembly 90 is mounted on a snowboard 93. The snowboard binding assembly 90 includes a buckle 100 that is attached to an instep pad 95. The instep pad 95 includes a strap that couples the buckle 100 to the medial side of a binding frame (not shown). The buckle 100 engages a ladder strap 80 having a plurality of sawtooth shaped, transverse teeth 85. The ladder strap 80 is coupled to the lateral side of the binding assembly 90. The binding assembly 90 is secured to the snowboard 93 and receives the snowboard boot between lateral and medial sides thereof. In this particular example, the ratchet-type buckle 100 includes a transversely-mounted, rotatable toothed barrel 140 that engages some of the strap teeth 85, and a lever 170 that provides leverage for driving the toothed barrel 140 to securely tighten the strap 80. It will be appreciated that very significant stresses can thereby be applied to the teeth 85 of the strap 80 by the toothed barrel 140.

In typical applications relating to sporting footwear, the ladder strap must be flexible enough to conform to the curved outer contours of the user's boot—for example, about the ankle, instep, or toe portion of the boot—while also being strong enough to be retained by a clasping mechanism during vigorous use. Flexibility is also required to permit the user to insert the strap into the fastener assembly, and to permit the strap to flex out of the user's way for easy insertion or removal of the user's foot in the binding (or into the boot itself in other applications such as skates, etc.). Moreover, because ladder straps are frequently used with alpine and other snow sports equipment and footwear, the ladder strap must exhibit the desired flexibility and strength at low temperatures and in wet environments.

In particular, in the examplary snowboarding binding application shown in FIG. 1, the ladder strap 80 must be soft and flexible at cold temperatures, so that the strap 80 can be easily fed into the ratchet buckle 100; and it must not break when bent at a sharp angle or stepped on. The strap teeth 85 must be strong enough that they are not sheered off or otherwise damaged by the high stresses imparted by the ratchet-buckle toothed barrel 140 during tightening of the strap, and during subsequent rigorous snowboarding.

It has always been a challenge in designing ladder straps to find or select one material that is strong enough to withstand the forces that will be applied to the teeth of the strap and yet produce a strap that is flexible enough to operate properly at cold temperatures without becoming brittle or cracking, and wherein the strap can be easily fed into the ratchet buckle. Moreover, it will be appreciated that a typical day of snowboard riding may require releasing and securing the binding strap numerous times—for example, to release the boot from its binding prior to ascending the mountain on a chair lift and then, upon arrival, re-securing the strap prior to riding down the trail.

The problems associated with prior art ladder straps are seen most clearly from the fact that, in practice, ladder straps are the most commonly replaced parts in the snowboard binding industry. They have the highest failure rate and require the greatest number of replacement parts ordered for warranty. Improving the performance and durability of the ladder strap could save manufacturing costs and reduce cost and inconvenience to the end user.

SUMMARY OF THE INVENTION

The present invention is directed to a ladder strap and a method of making ladder straps, wherein the ladder strap is flexible enough, particularly at low temperatures, to be flexed out of the way and to be wrapped around an object, such as a part of the ankle portion of a sports boot, while also having teeth that are strong and hard enough to withstand rigorous use—for example, the high stresses applied by a ratchet-type buckle—without damage to the teeth. In a preferred embodiment of the present invention, a first, relatively supple material is provided to a mold to produce a lower strap portion, and then a second, harder material is co-molded or otherwise joined to the first material to produce a unitary strap that exhibits the desired flexibility and hardness characteristics.

In an aspect of the invention, the teeth of the ladder strap are substantially composed of the second, harder material.

In an aspect of a preferred embodiment of the invention the ladder strap includes a lower strap portion made from a supple, first thermoplastic urethane and an upper strap portion made from a relatively hard second thermoplastic urethane.

In another aspect of a preferred embodiment of the invention, the first and second thermoplastic urethane materials are co-molded using an injection molding process.

In another aspect of a preferred embodiment of the invention, the co-molding process causes the upper and lower strap portions to be molecularly bonded together.

In another aspect of a preferred embodiment of the invention, the interface between the upper and lower strap portions is of a complex shape such that the first and second strap portions are mechanically interlocked.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

As used herein, the term "co-molding" refers to a process of molding in combination two different materials, such as two different thermoplastic urethanes (TPUs), to produce a unitary component. Although any suitable material may be utilized in the present invention, the presently preferred class of materials is TPU, members of which having suitable strength, flexibility, and hardness physical properties. TPUs are known in the art and can be produced in a wide range of hardness, flexibility, and low-temperature impact strength, having good toughness and abrasion resistance properties. Co-molding of TPUs may be accomplished, for example, using well-known injection molding processes. In one such process, a quantity of a first injectable polymer material is injected into a mold cavity formed between a pair of dies. The first polymer is then allowed to at least partially set or cure. A second die piece is then introduced or the dies are moved relative to one another or otherwise adapted to create a second mold cavity, the second mold cavity being partially filled by the first material. A quantity of the second polymer material is then injected to substantially fill the remaining available space in the second mold cavity, the second material contacting the molten or partially solidified first material. When the second material sets, the two materials are physically joined to one another. In an alternative co-molding process, sometimes referred to as co-injection, the two materials are injected into a single mold at about the same time, without waiting for the first material to partially set. The two materials are injected in a manner that allows the two materials to maintain at least partially a separate identity, i.e., they do not become fully mixed.

It will be appreciated by one of skill in the art that co-molding two appropriate materials will produce a molecular (or chemical) bond, binding the two materials. Additionally, the two materials may be mechanically interlocked by designing the shape of the interface between the two materials to be suitably complex. The co-molding process allows a single, integral part to be formed from two or more different materials, e.g., plastic materials, in a single mold, with no further assembly steps, attachment hardware, or adhesives required. It will be appreciated by one of skill in the art that various suitable co-molding processes or other joining techniques such as gluing may be used to produce a single, integral component from two different polymeric materials. Alternatively, other joining techniques may be used to join a relatively flexible strap material with a relatively hard strap material, without departing from the scope of the present invention.

Figure 1:
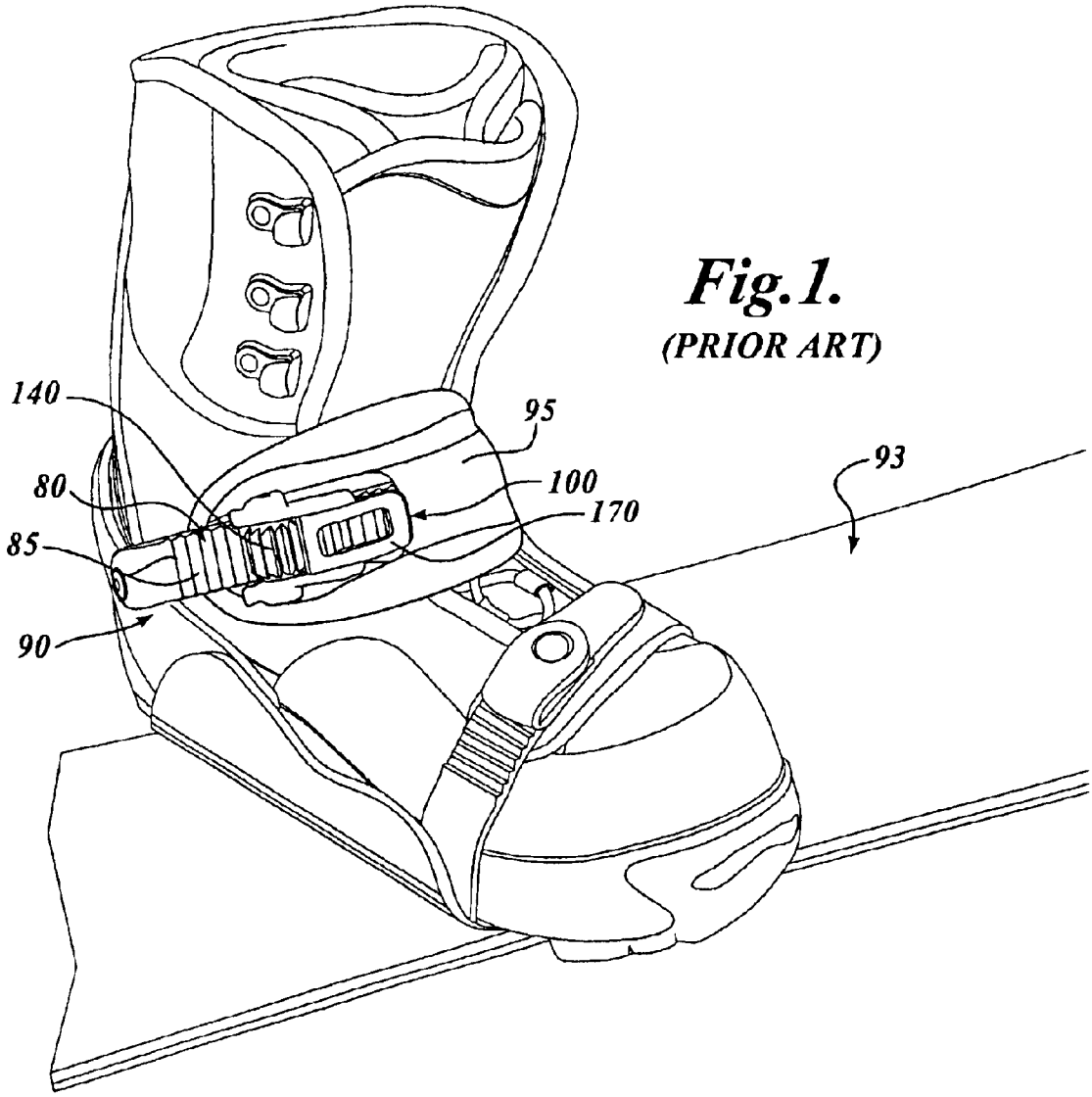
Fig.1. (PRIOR ART)
FIG. 1 shows a prior art snowboard boot having a ratchet-type buckle and a ladder strap.
Figure 3:
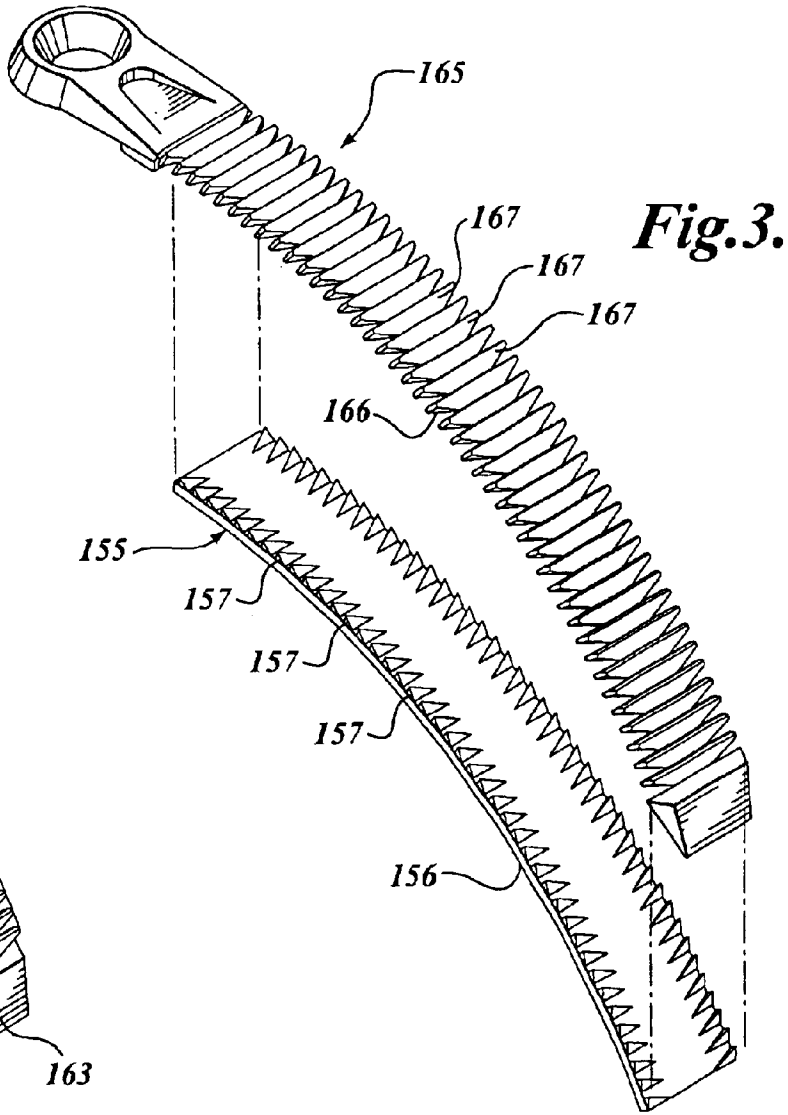
FIG. 3 is a perspective exploded view of the ladder strap shown in FIG. 2.
Figure 2:
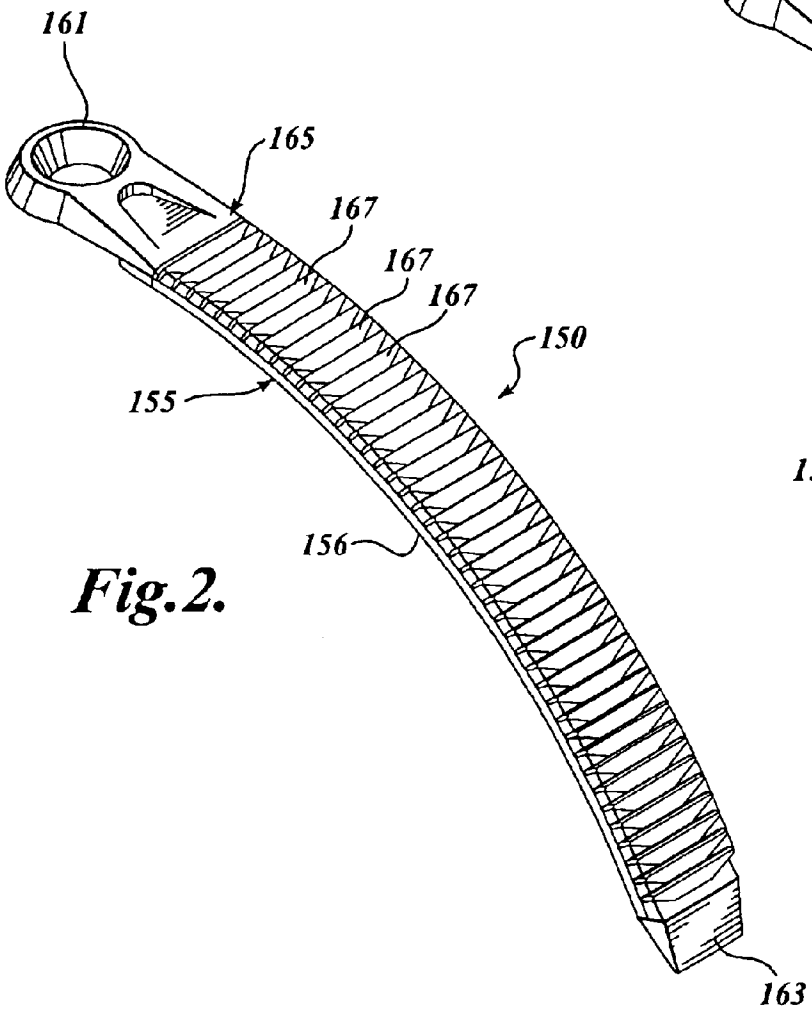
FIG. 2 is a perspective view of a first embodiment of a co-molded ladder strap according to the present invention.

Referring now to the figures, wherein like numbers indicate like parts, a first embodiment of a ladder strap 150 according to the present invention is shown in FIGS. 2 and 3. The ladder strap 150 includes a lower strap portion 155 having a first set of material properties and an upper strap portion 165 having a second set of material properties. The lower strap portion 155 is preferably smooth on its undersurface 156, and includes a plurality of teeth 157 on its upper surface. The teeth 157 in this embodiment are taller at the outer edges of the lower strap portion 155 and taper inwardly. The lower strap portion 155 is preferably a relatively soft, injectable, thermoplastic urethane (TPU), having good flexibility and strength characteristics at low temperatures.

Figure 4:
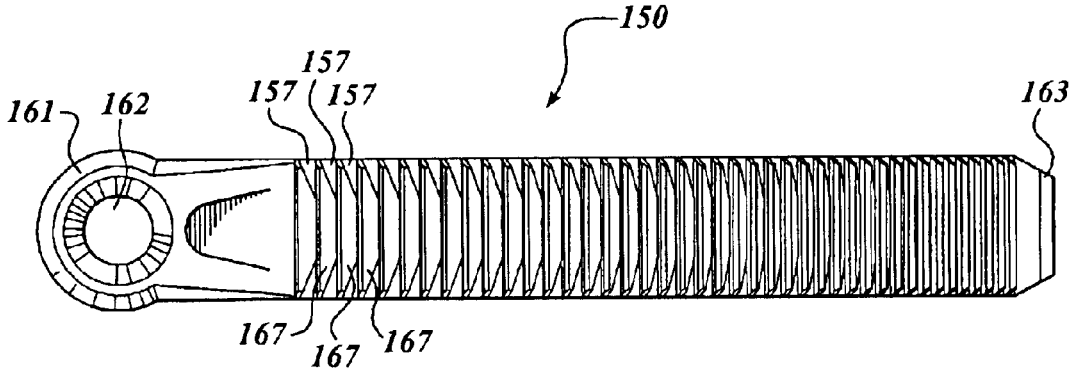
FIG. 4 is a plan view of the ladder strap shown in FIG. 2.
Figure 5:
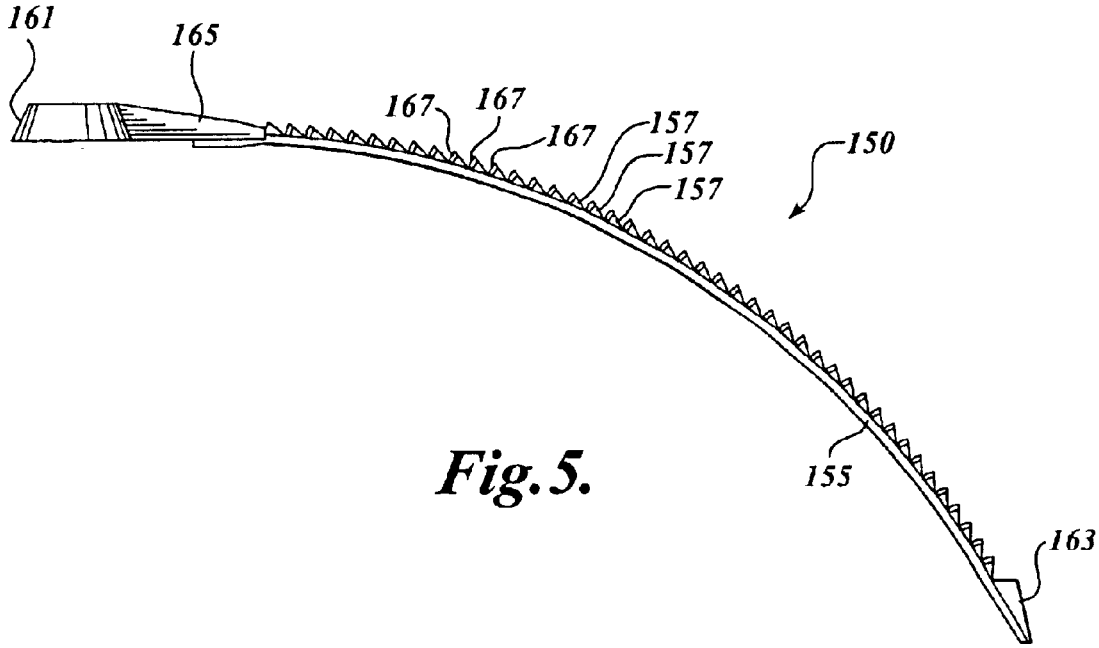
FIG. 5 is a side view of the ladder strap shown in FIG. 2.

The upper strap portion 165 has an undersurface 166 that generally conforms to the toothed upper surface 157 of the lower strap portion 155, and an upper portion having a plurality of buckle-engagement teeth 167. Referring now also to FIGS. 4 and 5, in this embodiment, a proximal end 161 of the ladder strap 150 includes an aperture 162 to facilitate installing the ladder strap 150 on an apparatus, such as a snowboard binding or boot. It will be apparent that a large number of other attachment mechanisms are well known in the art, and may alternatively be employed without departing from the present invention—including, for example, embedded connectors, stitching, adhesives, and the like. The ladder strap distal end 163 is preferably tapered to facilitate inserting the strap into a buckle assembly (not shown). The upper strap portion 165 is relatively stiff and hard. Preferably, both the lower strap portion 155 and the upper strap portion 165 are relatively strong so that the ladder strap 150 has good axial strength to meet the binding requirements of the desired application.

FIG. 3 shows an "exploded" view of the ladder strap 150, although it should be appreciated that the co-molded upper and lower strap portions 165 and 155, respectively, form a unitary ladder strap 150 wherein the strap portions are molecularly bonded. The lower surface of the upper strap portion 165 will therefore conform closely to the upper surface of the lower strap portion 155. It will be appreciated, however, that the teeth 157 on the lower strap portion 155 engage the corresponding underside of the upper strap portion 165, thereby mechanically coupling the upper and lower strap portions 165, 155 in addition to the molecular bond, thereby discouraging separation of the strap portions.

A plan view of the ladder strap 150 is shown in FIG. 4, and a side view is shown in FIG. 5. It will be appreciated from these figures that the buckle-engagement teeth 167 of the relatively hard upper strap portion 165 are positioned at the top of the strap teeth to engage the buckle (not shown). It will now be appreciated that the portion of the ladder strap 150 that must withstand the high local forces exerted by the buckle, i.e., the buckle-engagement teeth 167, are made from the hard upper strap material and are therefore less likely to be damaged by the buckle. These hard teeth 167 are supported by the relatively supple material of the lower strap portion 155.

Although the buckle-engagement teeth 167 of the ladder strap 150 are shown to be generally right triangular in profile; other shapes for the teeth 167 are also contemplated by the present invention. For example, the teeth 167 may have a quadrilateral profile, or a more complicated profile. The shape of the teeth 167 will typically be selected to accommodate the drive and/or holding mechanism of the corresponding buckle.

With reference to the relative hardness of the strap materials, it is also contemplated that the relatively hard upper strap material preferably has a Shore (durometer) hardness in the range of about 70–80 D, and the relatively supple lower strap material preferably has a Shore hardness in the range of about 45–55 D.

Figure 6:
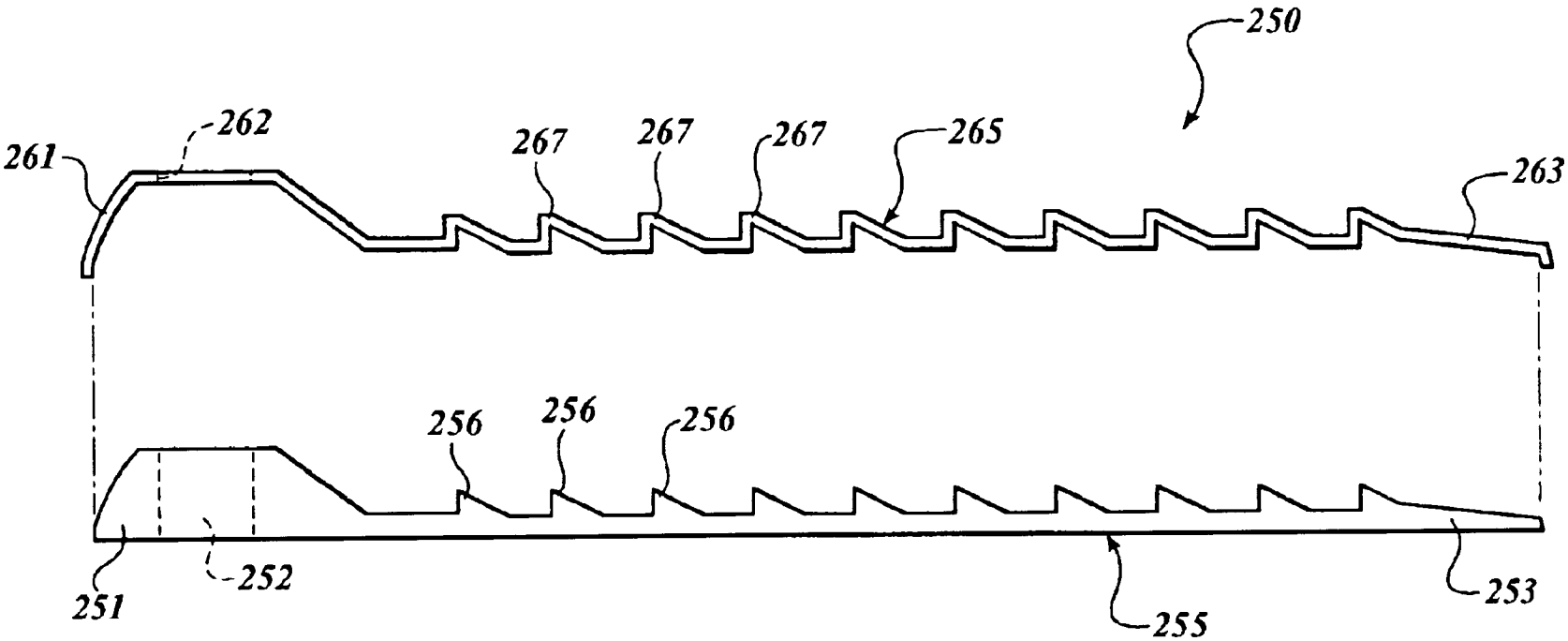
FIG. 6 is an exploded side view of a second embodiment of a co-molded ladder strap according to the present invention.

An exploded side view of a second embodiment of a co-molded ladder strap 250 according to the present invention is shown in FIG. 6. In this embodiment, the ladder strap 250 includes a relatively supple lower strap portion 255 and a relatively hard upper strap portion 265 that comprises basically a cover or cap over the lower strap portion 255. Again, it is to be understood that although shown in exploded view, the co-molded strap lower and upper portions 255 and 265, are molecularly bonded, and not intended to separate. It is contemplated that the upper strap portion 265 might also include inclined or vertical side wall portions (not shown) that cover the longitudinal edges of the lower strap portion 255, which edges may be tapered. The upper strap portion 265 and, in particular, the tapered side wall portions, might thereby impose a preferred curvature (not shown) on the lower strap portion 255—for example, to pre-dispose the strap to conform to the ankle portion of a snowboard boot.

The lower strap portion 155 includes a proximal end 251 that includes an aperture 252 for attachment to an apparatus, such as a sports boot (not shown), and a tapered distal end 253. The upper strap portion 165 includes a proximal end 261 that conforms to the proximal end 251 of the lower strap portion 255, and a distal end 263 that conforms to the distal end 253 of the lower strap portion 255. An aperture 262 in the upper strap portion 265 is generally aligned with the aperture 252 in the lower strap portion 255. Of course, the apertures 252, 262 may be drilled or otherwise imposed on the strap 250 after the co-molding process. The lower strap portion 255 includes a plurality of teeth 257 that extend laterally across the lower strap portion 255, and the upper strap portion 265 is shaped with teeth 267 that generally conform to, and overlie, the lower strap teeth 257.

While the presently preferred embodiments of the invention have been illustrated and described, it will be appreciated that various changes can be made therein without departing from the spirit and scope of the invention.

The embodiments of the invention in which an exclusive property or privilege is claimed are defined as follows:

1. A ladder strap comprising:

(a) an elongate first strap portion comprising a supple first material having a first hardness, the first strap portion having an upper surface and an undersurface, and wherein said upper surface includes a plurality of spaced protrusions; and (b) an elongate second strap portion, the second strap portion being joined to the upper surface of the first strap portion, the second strap portion comprising a second material, the second material having a second hardness that is greater than the first hardness;

(c) wherein the second strap portion further comprises a plurality of spaced-apart transverse teeth extending substantially across the width of the ladder strap, each of the transverse teeth defining an engagement surface that the teeth of the second strap overlie and bond with the teeth of the first strap and the teeth of said second strap are drivingly engaged by a ladder strap buckle.

2. The ladder strap of claim 1, wherein the second strap portion is joined to the second strap portion by co-molding the first and second strap portions.

3. The ladder strap of claim 1, wherein the first and second materials are thermoplastic urethanes.

4. The ladder strap of claim 3, wherein the first material has a hardness of about Shore 45–55 D.

5. The ladder strap of claim 4, wherein the second material has a hardness of about Shore 60–70 D.

6. The ladder strap of claim 1, wherein the second strap portion covers substantially all of the upper surface of the first strap portion.

7. The ladder strap of claim 1, wherein the second strap portion is molecularly bonded to the upper surface of the first strap portion.

8. The ladder strap of claim 1, wherein the upper surface of the first strap portion further comprises a plurality of transverse teeth elements, and further, wherein the second strap portion overlies the transverse teeth elements whereby the first strap portion and the second strap portion are mechanically coupled.

9. The ladder strap of claim 7, wherein the ladder strap further comprises a proximal end having means for facilitating attachment to another object and a tapered distal end.

* * * * *

UNITED STATES PATENT AND TRADEMARK OFFICE

CERTIFICATE OF CORRECTION

PATENT NO. : 6,898,826 B2
DATED : May 31, 2005
INVENTOR(S) : A.D. Draper et al.

It is certified that error appears in the above-identified patent and that said Letters Patent is hereby corrected as shown below:

Title page,
Item [57], ABSTRACT,
Line 5, "comprises" should read -- comprised --.

Column 6,
Line 9, "protrusions; and" should read -- protrusions; --.
Line 14, "hardness;" should read -- hardness; and --.

Signed and Sealed this

Eleventh Day of October, 2005

JON W. DUDAS
*Director of the United States Patent and Trademark Office*